US007566188B2

(12) United States Patent
Morizot et al.

(10) Patent No.: US 7,566,188 B2
(45) Date of Patent: Jul. 28, 2009

(54) METHOD AND DEVICE FOR INSERTING A DRAINAGE WICK

(75) Inventors: Jean-Claude Morizot, Paris (FR); Seth Pearlman, Pittsburgh, PA (US); Martin Taube, Pittsburg, PA (US)

(73) Assignee: Freyssinet (FR)

( * ) Notice: Subject to any disclaimer, the term of this patent is extended or adjusted under 35 U.S.C. 154(b) by 32 days.

(21) Appl. No.: 11/528,755

(22) Filed: Sep. 28, 2006

(65) Prior Publication Data

US 2008/0080932 A1 Apr. 3, 2008

(51) Int. Cl.
*E02B 11/00* (2006.01)

(52) U.S. Cl. ..... 405/50; 405/43; 405/45

(58) Field of Classification Search ..... 405/36, 405/43, 45, 50
See application file for complete search history.

(56) References Cited

U.S. PATENT DOCUMENTS

| | | | | |
|---|---|---|---|---|
| 2,577,252 | A | 12/1951 | Kjellman | |
| 3,396,541 | A * | 8/1968 | Bruce | 405/50 |
| 3,891,186 | A | 6/1975 | Thorsell | |
| 4,582,611 | A * | 4/1986 | Wang | 405/50 |
| 4,755,080 | A * | 7/1988 | Cortlever et al. | 405/50 |
| 5,584,603 | A * | 12/1996 | Cortlever | 405/50 |
| 5,658,091 | A * | 8/1997 | Goughnour et al. | 405/50 |
| 5,800,090 | A * | 9/1998 | Goughnour | 405/36 |
| 6,179,527 | B1 * | 1/2001 | Goughnour | 405/232 |
| 6,254,308 | B1 | 7/2001 | Cognon | |
| 6,312,190 | B1 * | 11/2001 | Goughnour | 405/36 |
| 6,766,817 | B2 | 7/2004 | da Silva | |
| 6,846,130 | B2 * | 1/2005 | Goughnour | 405/50 |
| 6,908,259 | B1 * | 6/2005 | Tomlinson | 405/36 |
| 6,918,404 | B2 | 7/2005 | da Silva | |
| 7,066,586 | B2 | 6/2006 | da Silva | |
| 7,285,255 | B2 | 10/2007 | Kadlec | |
| 2004/0146357 | A1 * | 7/2004 | Goughnour | 405/49 |
| 2005/0141964 | A1 * | 6/2005 | Tomlinson | 405/50 |
| 2007/0212281 | A1 | 9/2007 | Kadlec | |

(Continued)

FOREIGN PATENT DOCUMENTS

| | | |
|---|---|---|
| EP | 0226251 | 6/1987 |

(Continued)

OTHER PUBLICATIONS

Partial International Search Report cited in PCT/EP2007/060344.

(Continued)

*Primary Examiner*—Frederick L Lagman
(74) *Attorney, Agent, or Firm*—Banner & Witcoff, Ltd.

(57) ABSTRACT

A method and device for inserting a drainage wick into the ground wherein the method includes the steps of:

threading a drainage wick through an inserting tube;

fixing a portion of a tie to the lower end of the drainage wick;

fixing an anchorage component to another portion of said tie, where said tie is loose between the drainage wick lower end and the anchorage component when the anchorage component contacts the inserting tube lower end;

driving a anchorage component, the drainage wick and the inserting tube downwardly into the ground;

pulling up the inserting tube and the drainage wick, whereby said anchorage component is permitted to remain in the ground; and further pulling up the inserting tube whereby the anchorage component and the drainage wick are permitted to remain in the ground.

26 Claims, 5 Drawing Sheets

U.S. PATENT DOCUMENTS

| | | | |
|---|---|---|---|
| 2008/0080933 | A1 | 4/2008 | Morizot |

FOREIGN PATENT DOCUMENTS

| | | | |
|---|---|---|---|
| EP | 0233312 | A2 | 8/1987 |
| EP | 0672795 | | 9/1995 |
| EP | 1323868 | A1 | 7/2003 |
| EP | 1369533 | | 12/2003 |
| EP | 1369534 | | 12/2003 |
| GB | 1600737 | | 10/1981 |
| GB | 2131852 | A | 6/1984 |
| GB | 2134946 | A | 8/1984 |
| JP | 59034320 | | 2/1984 |
| WO | 9218702 | | 10/1992 |
| WO | 2004106639 | | 12/2004 |

OTHER PUBLICATIONS

International Search Report for PCT/EP2007/060341 mailed Feb. 21, 2008.

Unsolicited Email from Elson Silva, PhD, Three very important issues about fluidic devices in the Patenting System regarding Hydrology Fundamentals, (3 pages) Apr. 3, 2008.

Unsolicited Email from Elson Silva, PhD, Three very important issues above fluidic devices in the Patenting System regarding Hydrology Fundamentals, (3 pages) Apr. 3, 2008.

* cited by examiner

METHOD AND DEVICE FOR INSERTING A DRAINAGE WICK

BACKGROUND OF THE INVENTION

The invention relates to a method of inserting a drainage wick into the ground and to a device for anchoring the drainage wick.

Drainage wicks are commonly used for carrying out vertical draining in the ground in order to improve the strength of ground and generally consist of paper material in the form of strips or of a band-shaped plastic core enclosed in a suitable filter material.

Such drainage wicks are widely used to consolidate soft compressible soils (such as clays and/or fine grained soils). Consolidation of a compressible soil occurs as pore water is squeezed from the soil matrix. The installation of vertical drains provides shortened drainage paths for the water to exit the soil and thus can reduce significantly the soil settlement time.

In order to insert such a drainage wick in the ground, for example to a depth of 10 m up to 40 or 60 m, the drainage wick is threaded through an inserting tube or column after the tube is driven into the ground. When such an inserting tube is then extracted from the ground, the drainage wick remains in the soil, the soil pressurizes against the drainage wick, and water may travel through the permeable filter material of the drainage wick along the plastic core.

Such a drainage wick inserting method is disclosed in U.S. Pat. No. 2,577,252 and devices for inserting a drainage wick are disclosed in U.S. Pat. No. 3,891,186 or U.S. Pat. No. 4,755,080.

According to one prior art method, the drainage wick is threaded through the inserting tube and an anchorage component, such as a plate or bar, is attached to the lower end of said drainage wick. The drainage wick and anchorage component are then driven downwardly into the ground with or through said inserting tube. Said inserting tube is then pulled up whereby said anchorage component and said drainage wick are permitted to remain in the ground.

It has to be noted that while such a process is widely and commonly used, drawbacks still exist; namely, when the drainage wick needs to be inserted deeply and/or in soft soils. Frequently, in such conditions, the anchorage component does not stay at its bottom position when the inserting tube is pulled up from the soil and may also be pulled up, even to several meters. The efficiency of the drainage wick is then considerably reduced and in extreme cases annihilated if it is pulled out of the soil layer to be drained.

Solutions have been adopted to overcome such drawbacks such as:

- driving the drainage wick and the anchorage component deeper downwardly to a hard soil layer. The anchorage component is then more easily retained in the hard soil layer and the drainage wick is maintained in its bottom position. Such a solution still presents several drawbacks. First it increases the costs, due mainly to deeper installation and slowing down the wick drainage installation process. Second, such a process may be unusable due to geological constraint, such as aquifer presence in the hard soil. It is then necessary to avoid communication between the different soil layers to prevent water contamination. Third, the process is to be avoided when using vacuum soil consolidation as disclosed, for example, in U.S. Pat. No. 6,254,308. That is, as suction means are used to evacuate the liquid collected from the ground, the draining process would be endless if drainage wicks were to be in contact with underlying permeable soils.

- enlarging the anchorage component which is commonly roughly of the same size as the size of the section of the inserting tube. It is possible to use anchorage components which are significantly larger than the section of the inserting tube. They would be harder to move when the inserting tube is pulled up and remain easily in the bottom position. However, the use of such large anchorage components increases cost of such a component and significantly increases penetration resistance of the soil when installing the drainage wick.
- introducing water in the inserting tube to balance hydrostatic pressure at the bottom of the inserting tube and then pushing the anchorage component in the soil, allowing it to remain in the bottom position. However, such water filling of the inserting tube is time and energy consuming and is generally to be avoided.

SUMMARY OF THE INVENTION

It is an object of the invention to resolve the problems of anchorage component positioning and avoiding such previously described drawbacks with an inexpensive and non slowing process solution.

Generally, the previously described problems are addressed by using a method of inserting a drainage wick into the ground comprising the steps of:

- threading the drainage wick through an inserting or insertion tube, shaft or column;
- fixing a portion or end of a tie or connector to the lower end of the drainage wick extending out of the inserting tube;
- fixing an anchorage component to another portion or end of said tie or connector, where said tie is loose between the drainage wick lower end and the anchorage component when the anchorage component contacts the inserting tube lower end;
- driving the anchorage component, drainage wick and inserting tube downwardly into the ground;
- pulling up the inserting tube and drainage wick, whereby said anchorage component is permitted to remain in the ground; and
- further pulling up said inserting tube whereby said anchorage component and drainage wick are permitted to remain in said ground.

During the step of pulling up the inserting tube and drainage wick, the anchorage component is not pulled up and can easily remain lodged in position in the ground. The soil around the anchorage component can rearrange and apply an hydrostatic pressure on the anchorage component so that the anchorage component remains in its position when the tie is tightened and the drainage wick pulls on it during the step of further pulling up the inserting tube.

According to another feature of embodiments of the present invention the method comprises the steps of:

- jamming the drainage wick before the inserting tube is firstly pulled up;
- releasing the drainage wick before the inserting tube is further pulled up.

Such steps allow blockage of drainage wick during the step of pulling up the inserting tube and drainage wick.

A complementary feature to the method comprises the step of introducing compressed air in the inserting tube after the drainage wick jamming step. Introducing compressed air in the inserting tube enables pushing an anchorage component downwardly in the soil and makes its anchorage easier. Such a process is faster and less expensive than known processes where water is used to hold down an anchorage component.

According to another feature of embodiments of the invention, the method comprises the steps of:

closing the lower end of said inserting tube with a shutter before driving the anchorage component and drainage wick downwardly into the soil;

releasing said shutter before and/or when pulling up the inserting tube.

Adding a shutter to the driving tube may be useful if elements of the soil, namely mud, may penetrate into the inserting tube when driving it downwardly into the ground. An embodiment of the present invention includes an anchorage component having such a shutter.

According to still another feature of embodiments of the invention, the method comprises the step of filling the soil zone around the anchorage component with a sealing or retention material such as mud, clay or water expandable material, such as bentonite, water activated polymer, before and/or when the inserting tube and the drainage wick are pulled up and before the drainage wick is permitted to remain in the soil. It is then possible to further rearrange the soil during the step of pulling up the inserting tube and drainage wick and seal the soil around the anchorage component and/or the tie. Furthermore when water expandable material is used, water of the soil contacts the water expandable material which expands in volume and enhances the sealing and maintenance of the anchorage component into the soil.

According to another feature of embodiments of the invention, the distance between the position the anchorage component is permitted to remain in the soil and the position the drainage wick end is permitted to remain in the soil is at least about 0.10 m, and namely at least about 0.40 m. It is usually less than 2 m.

According to another feature, the tie or connector may be selected from the list comprising a rope, a cord, a cable, a strap.

According to a complementary feature, a water expandable material may be included in, or coated on said tie.

According to a further feature, the anchorage component and drainage wick are driven downwardly into a layer of soft soil and are permitted to remain in said layer of soft soil.

According to another feature, the anchorage component and drainage wick are driven downwardly into a layer of hard soil situated underneath a layer of soft soil and the anchorage component is permitted to remain in the layer of hard soil while said drainage wick is permitted to remain in said layer of soft soil.

In the disclosure, a layer of "soft soil" is a layer wherein anchoring is difficult such as, for example, mud, muddy soils, limon, vase, pit, pitty soils, soft clays.

In the disclosure, a layer of "hard soil" is a layer where anchoring is easier than in a soft soil layer. Hard soil layers are, for example, comprised of sand, sand and gravel, impervious clay, marl, weathered rocks. Hard soils are usually more permeable than soft soils.

In connection with the described methods, embodiments of the invention also relate to a device for inserting a drainage wick downwardly into the earth which includes:

an inserting or insertion tube, shaft or column that is adapted to generally surround and protect the drainage wick as the inserting tube penetrates downwardly into the earth, a guide such as a mast, or pole, which is designed to initially position said inserting tube vertically above the earth, means to move the inserting tube from its initial generally vertical position downwardly with respect to said guide so that the inserting tube and the drainage wick it protects will penetrate into earth, means for jamming said drainage wick into said inserting tube.

A device for inserting a drainage wick downwardly into the earth typically includes:

an inserting tube that is adapted to generally surround and protect the drainage wick as the inserting tube penetrates downwardly into the earth, a guide such as a mast, which is designed to initially position an inserting tube vertically above the earth, means to move the inserting tube from its initial vertical position downwardly with respect to said guide so that the inserting tube and the drainage wick it protects will penetrate into earth, a blockage element arranged in the inserting tube capable of operating to jam said drainage wick into the inserting tube.

According to one embodiment of the device the blockage element is a gas expandable balloon.

According to another embodiment of the device the blockage element is a movable plate, such as a folding plate or a plate that slides in a slot arranged in the inserting tube.

According to still another feature of the device a compressed gas inlet is arranged in the inserting tube below a blockage element when the device is in working position.

According to a complementary feature both the blockage element and the compressed gas inlet are arranged close to one another, near the upper end of said inserting tube.

The invention is further described in the detailed description of non limiting embodiments as depicted and explained below.

BRIEF DESCRIPTION OF THE DRAWINGS

FIG. 3 B is a diagrammatic transverse section along the lines III B-III B of FIG. 3 A.

DESCRIPTION OF PREFERRED EMBODIMENTS

Figure 1:
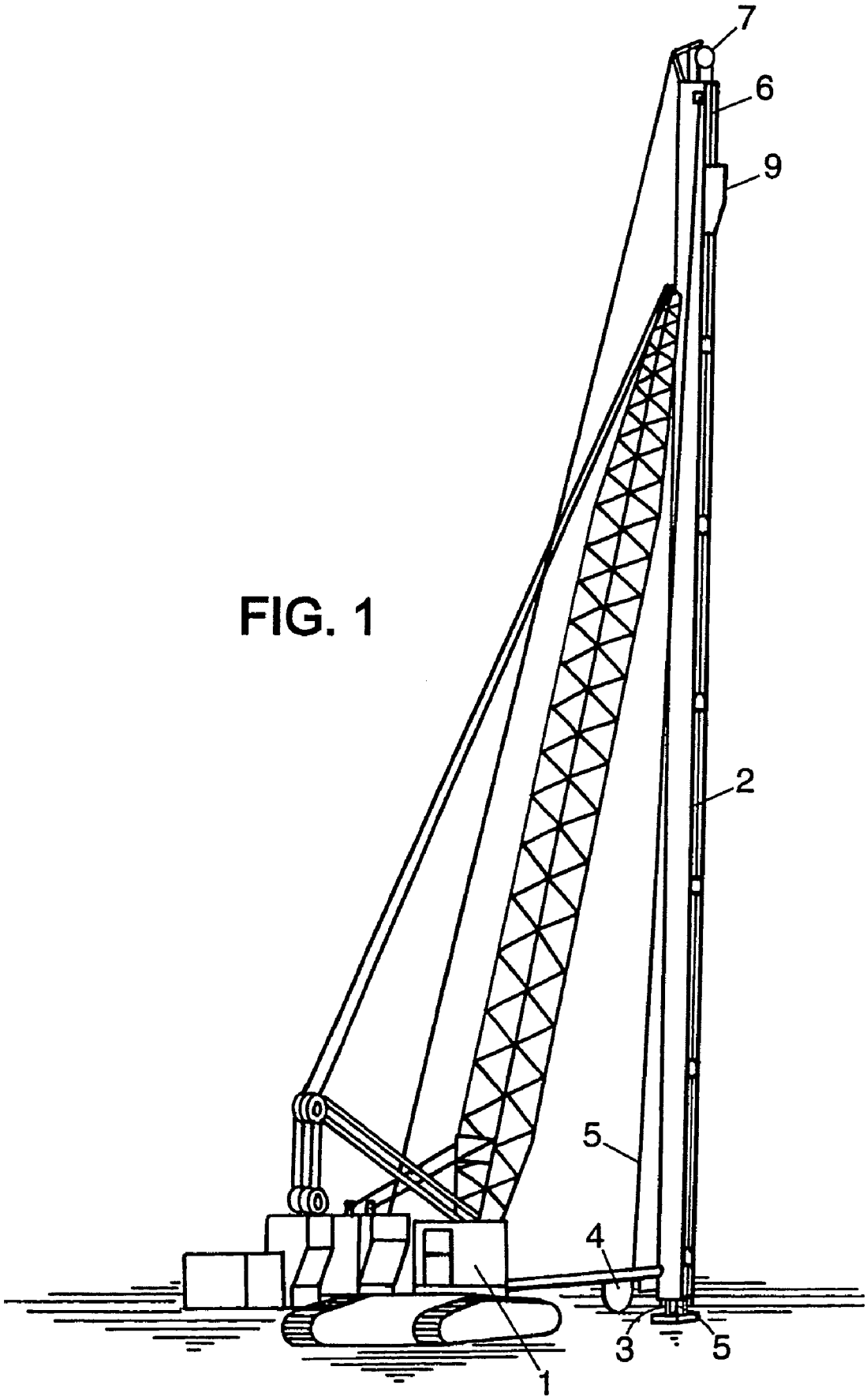
FIG. 1 shows a diagrammatic perspective view of a device used for implementing the process of an embodiment according to the invention.

An embodiment of a device used to implement an example of a process according to the invention is shown in FIG. 1 and comprises: a frame formed by a hydraulic crane 1; a mast, column, shaft or guide 2; an inserting tube 3; supply means 4 for a drainage wick 5; and a drive member such as a cable 6. Guide 2 is arranged in a generally vertical position in operating conditions.

The guide 2 may typically comprise a hollow tube for example, which has been inserted or is insertable into the soil. Assuming that the guide 2 has been inserted into the soil, the wick inserting tube 3 may then be moved or directed through the guide or guide tube 2 to transfer the drainage wick 5 into the soil. That is, the inserting tube 3 is moved in a downward direction through the guide tube 2 by means of a loop of cable 6 having opposite ends attached to a fastening element attached to the tube 3. The closed loop of cable 6 fits over the reversing driven wheel 7 at the top end of crane 1 and an idler 7A at the lower end of guide 2. The inserting tube 3 may therefore be set into movement by rotating the cable 6 about the reversing wheel 7. Alternatively, the inserting tube 3 may be directed in a downward direction into the soil by vibration means in guide tube 2.

Further steps of the described process are shown sequentially in FIGS. 2A-2D.

Figure 2B:
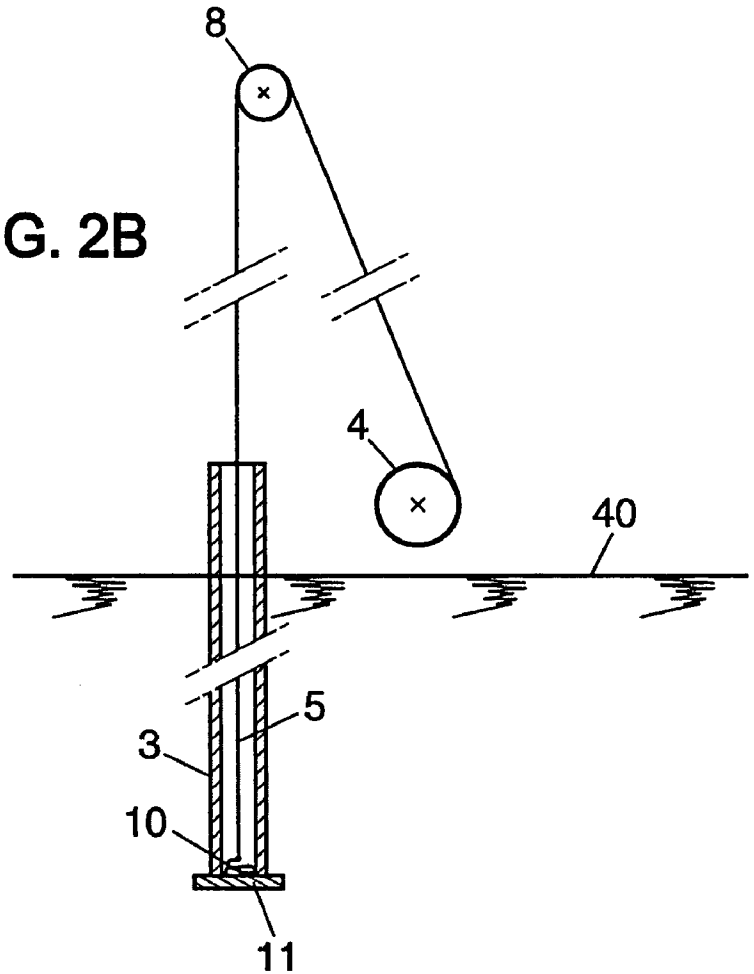
FIGS. 2A-2D are a series of diagrams of a longitudinal section of a portion of the device equipment depicting the different process steps.
Figure 2A:
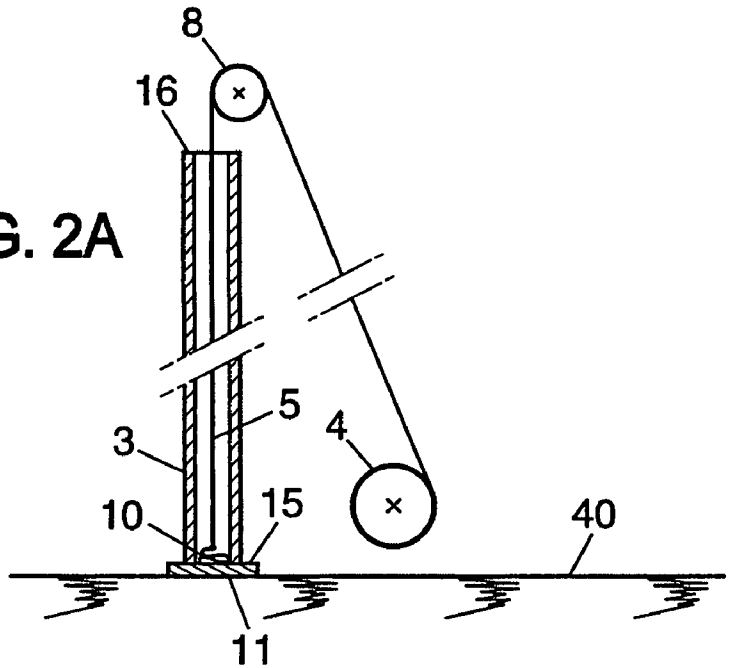
Figure 2D:
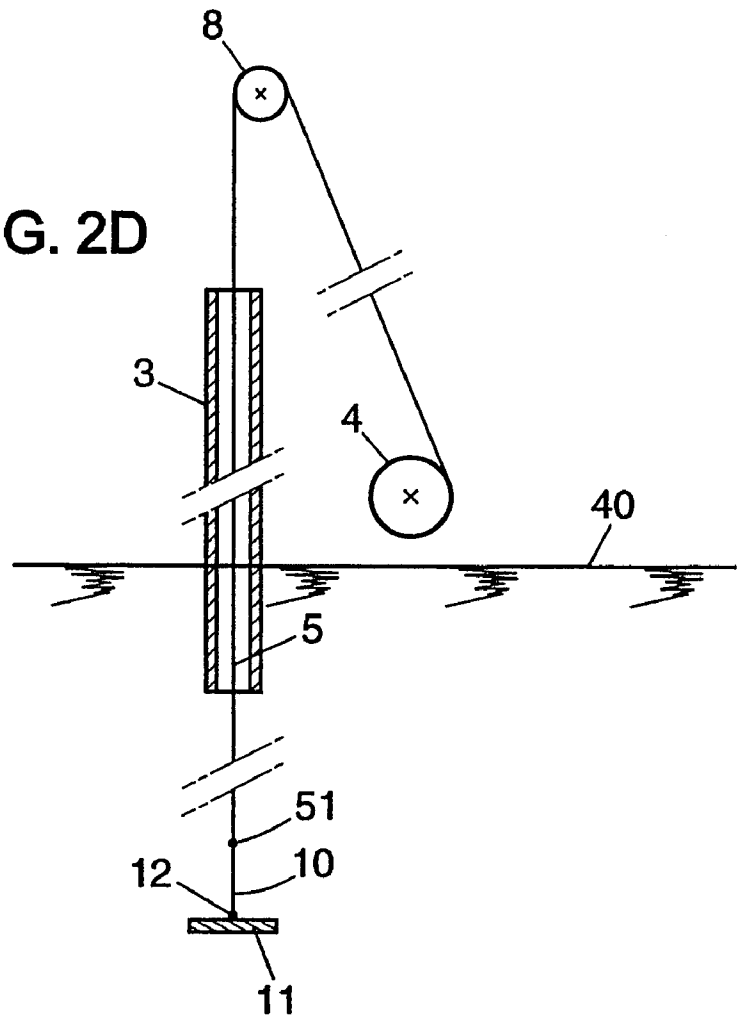

FIG. 2A shows the step before inserting the tube 3 into the ground: a drainage wick 5 is unwound from wick supply means 4, positioned or guided over a wheel 8 and threaded through inserting tube 3. When lower end 51 of drainage wick 5 is coming out or close to the lower end 15 of inserting tube 3, one can fix a portion of a loose tie or connector 10 at the lower end 51 of drainage wick 5 and another portion of said loose tie 10 to a fixation point 12, such as a ring, of anchorage component 11. (FIG. 2-C).

The anchorage component 11 shown in FIG. 2A is a disc which diameter is slightly larger than the maximum size of the external part of the section of inserting tube 3.

The distance between the anchorage component 11 and the lower end 51 of drainage wick 5 is lower or less than the distance between the two portions of the tie 10 fixed to above mentioned parts, 51 and 12. Thus initially, the anchorage component 11 is laying on the ground level 40; the drainage wick lower end 51 is situated just above it, and the lower end 15 of inserting tube 3 contacts said anchorage component 11 so that the tie or connector 10 is loose or unextended.

FIG. 2B illustrates the driving step of anchorage component 11 and drainage wick 5 downwardly into the ground with inserting tube 3. The tie 10 remains loose.

According to an embodiment of the present invention, loose tie 10 is kept loose thanks to a temporary bond. Drainage wick 5 and anchorage component 11 are driven downwardly into the ground by means of inserting tube 3. The strength of said temporary bond is designed as to be higher than tractive effort when driving inserting tube 3 downwardly and lower than anchorage resistance of anchorage component 11. The temporary bond breaks when pulling up inserting tube 3.

According to another embodiment of the present invention, means are included in the device for inserting the drainage wick so that the distance between wheel 8 and upper part 16 of inserting tube 3 remains constant when driving inserting tube 3 downwardly. No stress is applied on drainage wick 5 nor tie 10, so that tie 10 remains loose when driving downwardly into the ground inserting tube 3.

Figure 2C:
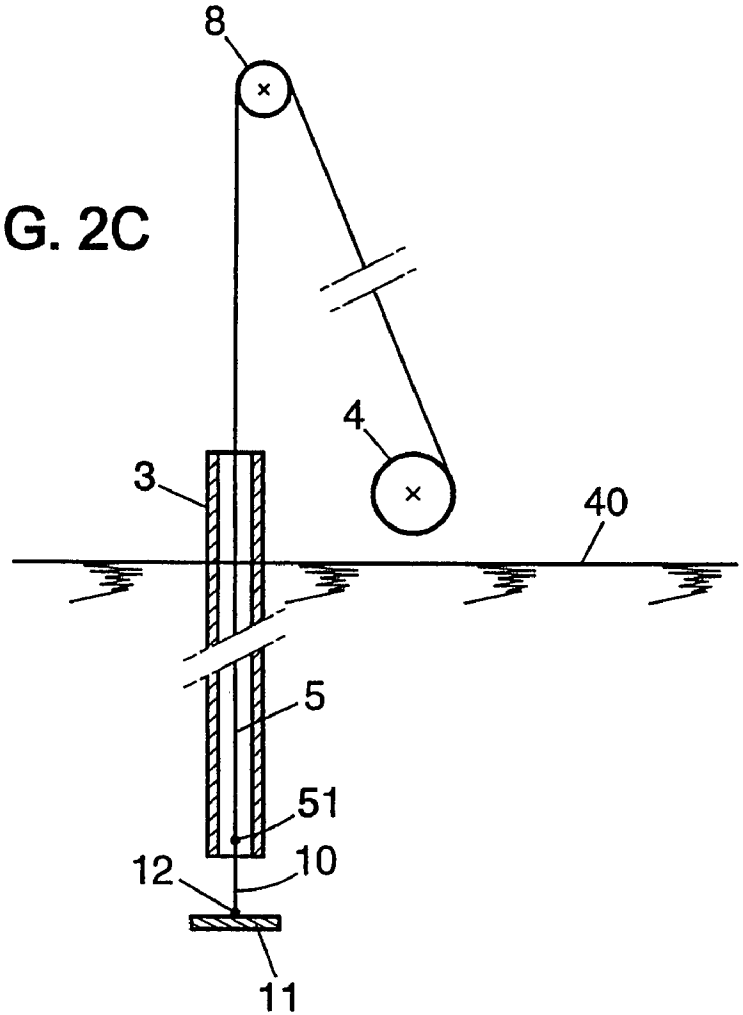

When the lowest desired position of the inserting tube 3 is reached, the inserting tube 3 is pulled up and the anchorage component 11 is permitted to remain into the ground. The lower end 51 of the drainage wick remains inside the inserting tube 3 up to the moment where the tie portion 10 between the lower end 51 of drainage wick 5 and fixation point 12 of anchorage component 11 is completely tightened as shown in FIG. 2C. The distance between lower end 51 of drainage wick 5 and fixation point 12 of anchorage component 11 is then, for example, 1 meter.

The inserting tube 3 is subsequently pulled up further detaching the lower end 51 from tube 3 and the anchorage component 11 pulls on drainage wick 5 so that both anchorage component 11 and drainage wick 5 are permitted to remain into the ground.

After pulling out inserting tube 3, drainage wick 5 is cut near ground level 40 and another drainage wick can be installed.

Figure 3A:
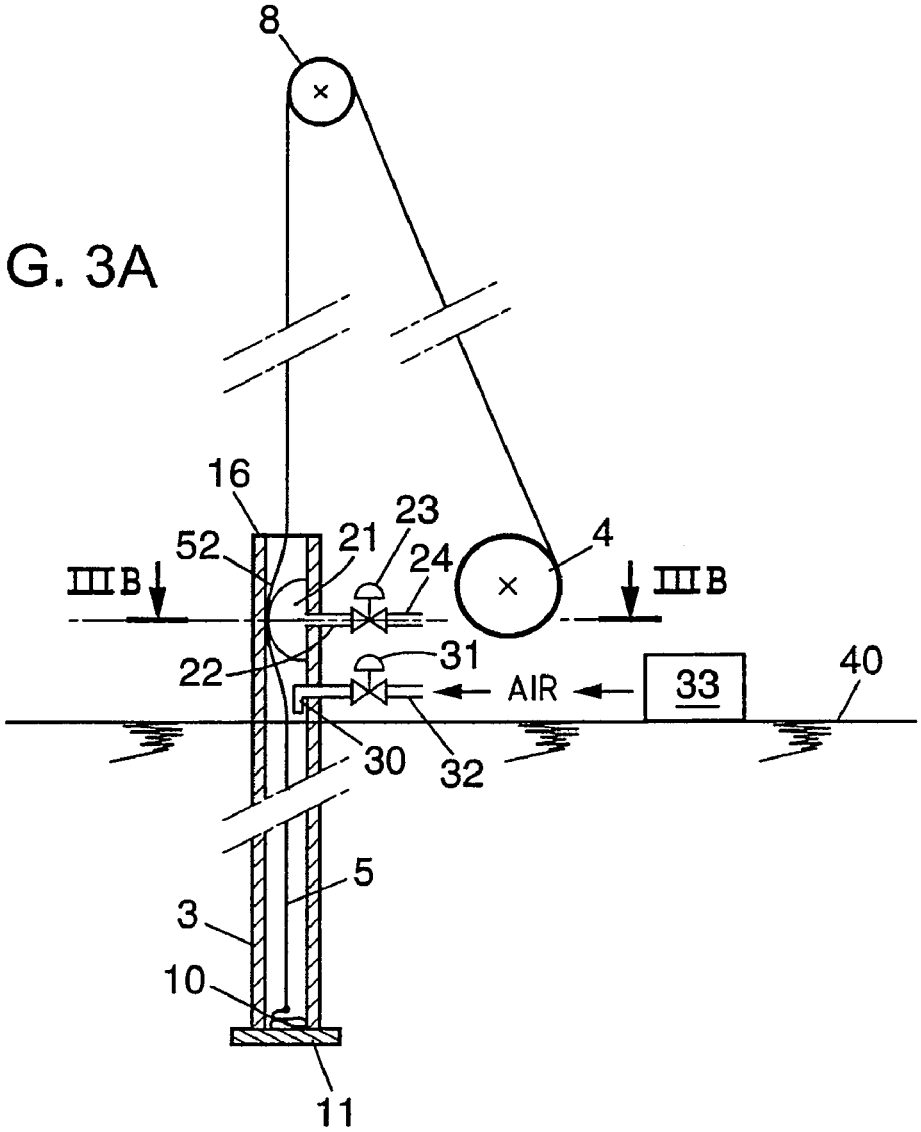
FIG. 3 A is a diagrammatic longitudinal section of a portion of an embodiment of a device according to the invention.

Referring to FIG. 3A, gas, namely compressed air, may be introduced in inserting tube 3 when frictional means or retention means, such as a balloon 21, compresses drainage wick 5 into the internal wall of inserting tube 3. Thus, valve 23 may be opened to permit pressurized air from conduit 24 to flow through inlet conduit 22 to expand balloon 21 from its uninflated position (20 in FIG. 4) to its expanded position depicted in FIGS. 3 and 4. In the expanded position, wick 5 is fixed in tube 3 and will be pulled from storage drum 4 over pulley or wheel 8 as tube 8 moves into the soil. In this manner, strain on wick 5 is diminished and the bond at end 51 is maintained during placement of tube 3 into the soil.

Also, in the device of FIG. 3 A, a gas inlet 30 is located under balloon 21 to provide compressed air generated by compressor 33. A tube 32 connects compressor 33 to a valve 31. Valve 31 is opened when it is desired to introduce compressed gas into inserting tube 3 in order to push anchorage component 11 into the ground.

Figure 3B:
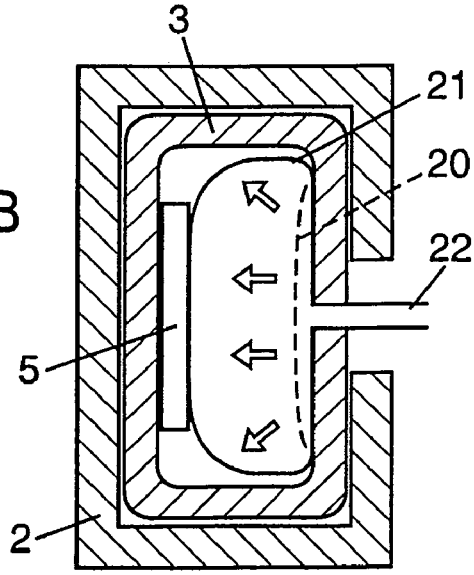

Referring to FIG. 3B there is further depicted the schematic view of the mechanism which may be used to retaining the drainage wick 5 in engagement with the interior wall of the inserting tube 3. Thus, there is depicted the external guide or guide tube 2 which receives the inserting tube 3. The wick 5 is positioned within the inserting tube 3. Inflatable balloon 21 may be expanded from a non-engaged position 20 to an engaged position, as depicted in FIG. 3B by providing compressed gas through the inlet 22. In this manner, the wick 5 will be held in a fixed position within the inserting tube 3 as the tube 3 is driven or positioned into the soil by movement within the guide 2. Thus, the wick 5 will be in position during removal of the insertion tube 3.

Figure 4:
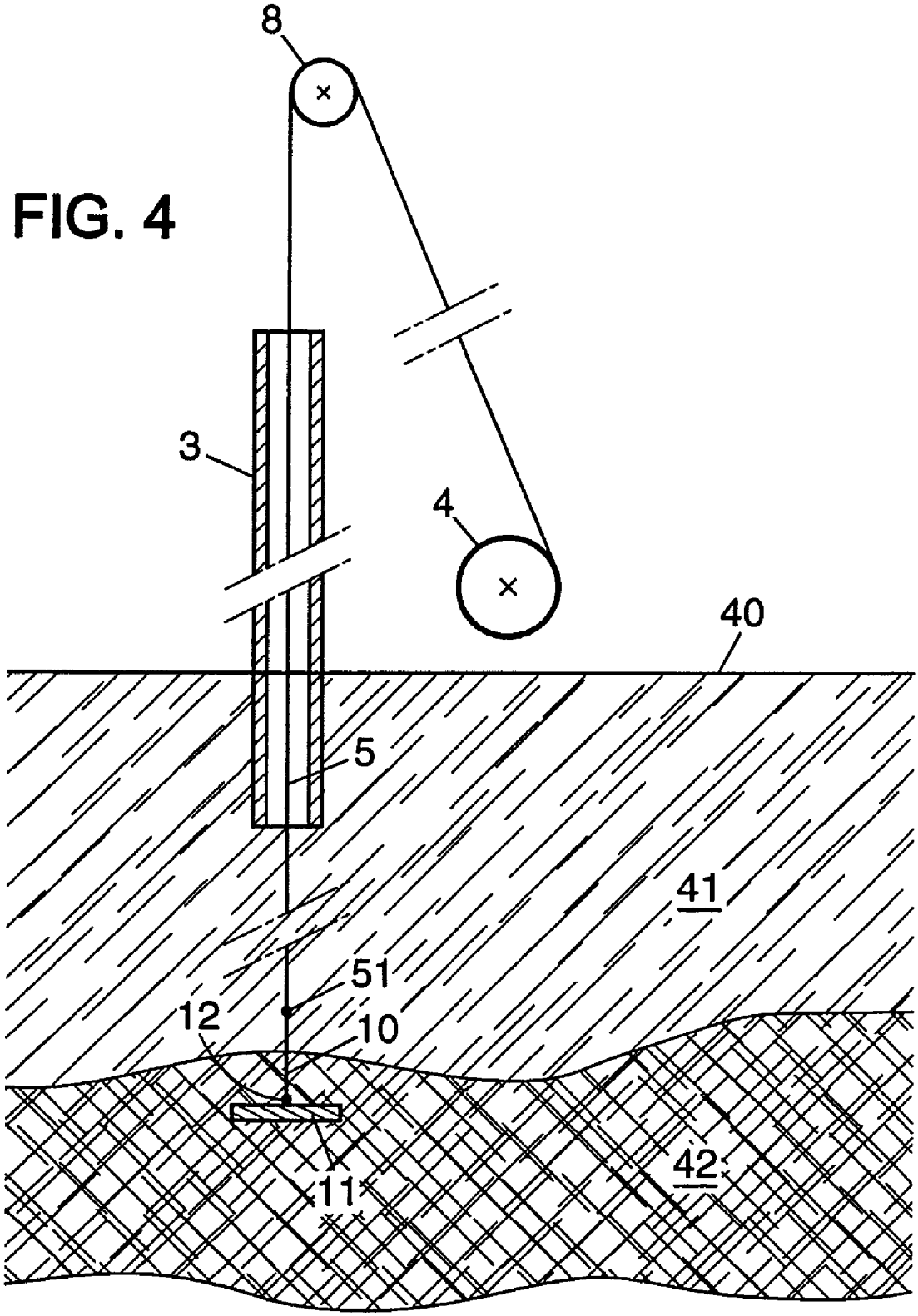
FIG. 4 is a diagrammatic longitudinal section of a portion of the equipment and of the ground according to one process feature of the invention.

FIG. 4 shows an application of the process and apparatus disclosed. The ground in FIG. 4 consists of two soil layers: layer 41 is a soft soil layer and layer 42 is a hard soil layer.

Inserting tube 3, anchorage component 11 and the bottom of drainage wick 5 are driven downwardly into the hard soil layer 42, penetrating in said hard soil layer 42 to a distance less than the length between fixation points 12, 51 of tie 10 when tie 10 is tightened. Inserting tube 3 and drainage wick 5 are then pulled up and the bottom end 51 of drainage wick 5 is, as a result, located in the soft soil layer 41 above the hard soil layer 42. It is thus possible to take advantage of the hard soil layer 42 to fix anchorage component 11.

The soil around anchorage component 1 typically rearranges when pulling up inserting tube 3 and drainage wick 5. As bottom end 51 of drainage wick 5 is located in soft soil layer, no connection between hard soil 42 and drainage wick 5 can occur, since they are separated by a tie connection or connector, which is typically not water conductive. It is then possible to avoid water contamination when hard soil 42 contains aquifer table or to allow processing vacuum soil consolidation.

The invention is not restricted to the above described embodiments which can be varied in a number of ways within the scope of the claims.

The invention claimed is:

1. A method for inserting a drainage wick into the ground comprising the steps of:

threading said drainage wick through an inserting tube;

fixing a portion of a connecting tie to the lower end of said drainage wick;

fixing an anchorage component to another a spaced and separate portion of said connecting tie, where said connecting tie is loose between the drainage wick lower end and the anchorage component;

driving said anchorage component, said drainage wick and said inserting tube downwardly into the ground;

pulling up said inserting tube and said drainage wick, whereby said anchorage component is permitted to remain in said ground; and further pulling up said inserting tube whereby said anchorage component and said drainage wick are permitted to remain in said ground, said wick lower end being separated and spaced from said anchorage component at least about 0.1 meter.

2. A method according to claim 1 comprising the steps of:
jamming the drainage wick before the inserting tube is firstly pulled up;
releasing the drainage wick before the inserting tube is further pulled up.

3. A method according to claim 2 comprising the step of introducing compressed air in said inserting tube after the drainage wick jamming step.

4. A method according to claim 1 comprising the steps of:
closing the lower end of said inserting tube with a shutter before driving said anchorage component and said drainage wick downwardly into the soil
releasing said shutter before and/or when pulling up said inserting tube.

5. A method according to claim 1 comprising the step of filling the soil zone around the anchorage component with a sealing material before or when said inserting tube and said drainage wick are pulled up.

6. A method according to claim 5 where said sealing material comprises water expandable material.

7. A method according to claim 1 where the distance between the position the anchorage component is permitted to remain in the soil and the position the drainage wick lower end is permitted to remain in the soil is at least about 0.10 m, and preferably no more than about 2 m.

8. A method according to claim 1 where said tie is selected from the group consisting of a rope, a cord, a cable.

9. A method according to claim 1 where said anchorage component and said drainage wick are driven downwardly into a layer of soft soil and are permitted to remain in said layer of soft soil.

10. A method according to claim 1 where said anchorage component and said drainage wick are driven downwardly into a layer of hard soil situated underneath a layer of soft soil and said anchorage component is permitted to remain in said layer of hard soil where said drainage wick is permitted to remain in said layer of soft soil.

11. A device for inserting a drainage wick downwardly into the earth and which includes:
a drainage wick with a lower end;
an inserting tube that is adapted to surround and protect said drainage wick as the inserting tube penetrates downwardly into the earth,
a separate anchorage component at the lower end of the inserting tube;
a separate connecting tie connected from the lower end of the wick to the anchorage component by at least about 0.1 m distance
a guide which is designed to initially position said inserting tube generally vertically above the earth, and
means to move said inserting tube from its initial generally vertical position downwardly with respect to said guide so that said inserting tube and the drainage wick it protects will penetrate into earth so that said inserting tube and said lower end of said wick may be moved to a position at least about 0.1 meter; and
a blockage element arranged in said inserting tube able to operate to retain said drainage wick in said inserting tube.

12. A device according to claim 11 where said blockage element is a gas expandable balloon.

13. A device according to claim 11 where said blockage element is a movable plate, such as a folding plate or a plate sliding in a slot arranged in said inserting tube.

14. A device according to claim 11 comprising a compressed gas inlet arranged in said inserting tube below said blockage element.

15. A device according to claim 14 where both blockage element and compressed gas inlet are arranged close to one another, near the upper end of said inserting tube.

16. A device according to claim 11 further including a blockage element arranged into said inserting tube able to operate to retain said drainage wick in said inserting tube.

17. A method for inserting a drainage wick into the ground comprising the steps of:
threading said drainage wick through an inserting tube;
fixing a portion of a tie to the lower end of said drainage wick;
fixing an anchorage component to another portion of said tie, where said tie is loose between the drainage wick lower end and the anchorage component;
driving said anchorage component, said drainage wick and said inserting tube downwardly into the ground;
pulling up said inserting tube and said drainage wick, whereby said anchorage component is permitted to remain into said ground;
further pulling up said inserting tube whereby said anchorage component and said drainage wick are permitted to remain into said ground, said wick being separated from said anchorage component; and
filling a soil zone around the anchorage component with a sealing material before or when said inserting tube and said drainage wick are pulled up.

18. A method according to claim 17 comprising the steps of:
jamming the drainage wick before the inserting tube is firstly pulled up; and
releasing the drainage wick before the inserting tube is further pulled up.

19. A method according to claim 18 comprising the step of introducing compressed air in said inserting tube after the drainage wick jamming step.

20. A method according to claim 17 comprising the steps of:
closing the lower end of said inserting tube with a shutter before driving said anchorage component and said drainage wick downwardly into the soil; and
releasing said shutter before and/or when pulling up said inserting tube.

21. A method according to claim 17 comprising the step of filling a soil zone around the anchorage component with a sealing material before or when said inserting tube and said drainage wick are pulled up.

22. A method according to claim 17 where the distance between the position the anchorage component is permitted to remain in the soil and the position the drainage wick lower end is permitted to remain in the soil is at least about 0.10 m, and preferably no more than about 2 m.

23. A method according to claim 17 where said tie is selected from the group consisting of a rope, a cored, a cable.

24. A method according to claim 17 where said sealing material comprises water expandable material.

25. A method according to claim 17 where said anchorage component and said drainage wick and driven downwardly into a layer of soft soil and are permitted to remain in said layer of soft soil.

26. A method according to claim 17 where said anchorage component and said drainage wick are driven downwardly into a layer of hard soil situated underneath a layer of soft soil and said anchorage component is permitted to remain in said layer of hard soil where said drainage wick is permitted to remain in said layer of soft soil.

* * * * *